US010347069B2

(12) United States Patent
Su et al.

(10) Patent No.: US 10,347,069 B2
(45) Date of Patent: Jul. 9, 2019

(54) APPARATUS, METHOD AND ASSEMBLY FOR CHECKING VALUE DOCUMENTS, IN PARTICULAR BANK NOTES, AND VALUE-DOCUMENT PROCESSING SYSTEM

(71) Applicant: GIESECKE+DEVRIENT CURRENCY TECHNOLOGY GMBH, Munich (DE)

(72) Inventors: Shanchuan Su, Neubiberg (DE); Steffen Schmalz, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 32 days.

(21) Appl. No.: 15/852,058

(22) Filed: Dec. 22, 2017

(65) Prior Publication Data

US 2018/0122174 A1 May 3, 2018

Related U.S. Application Data

(63) Continuation-in-part of application No. 14/784,883, filed as application No. PCT/EP2014/001055 on Apr. 17, 2014, now Pat. No. 9,852,568.

(30) Foreign Application Priority Data

Apr. 17, 2014 (DE) ..... 10 2013 006 925

(51) Int. Cl.
*G07D 7/20* (2016.01)
*G07D 7/06* (2006.01)
*G07D 7/005* (2016.01)

(52) U.S. Cl.
CPC ..... *G07D 7/2016* (2013.01); *G07D 7/06* (2013.01); *G07D 7/005* (2017.05)

(58) Field of Classification Search
CPC .. G07D 7/00; G07D 7/12; G07D 7/18; G07D 7/2016; G07D 7/06; G07D 7/005;
(Continued)

(56) References Cited

U.S. PATENT DOCUMENTS 8,917,386 B2 12/2014 Holl et al.
8,976,420 B2 3/2015 Steidl
(Continued)

FOREIGN PATENT DOCUMENTS

DE 10227354 A1 1/2004
DE 102005009332 A1 9/2006
(Continued)

OTHER PUBLICATIONS

German Search Report from DE Application No. 102013006925.4, dated Oct. 28, 2013.
(Continued)

*Primary Examiner* — Jamil Ahmed
(74) *Attorney, Agent, or Firm* — Workman Nydegger

(57) ABSTRACT

An apparatus and method for checking value documents, in particular bank notes, and a value document processing system having at least one sensor for capturing an electromagnetic radiation transmitted by a value document and generating corresponding transmission signals, and an evaluation device for checking whether the value document has a foreign object taking into account the transmission signals. From the transmission signals an edge course of the value document is derived and a rectangle is approximated to the edge course. By comparing the edge course of the transmission image with the rectangle, the presence of a foreign object such as an adhesive tape, can be ascertained.

21 Claims, 3 Drawing Sheets

(58) Field of Classification Search
CPC .. G07D 7/0006; G06K 9/186; G06K 9/00442; G06K 9/00; G01N 21/84; G06F 17/30598; G01J 1/42; G06Q 40/00
See application file for complete search history.

(56) References Cited

U.S. PATENT DOCUMENTS

| | | | | |
|---|---|---|---|---|
| 2003/0043365 | A1 | 3/2003 | Ross et al. | |
| 2010/0128965 | A1 | 5/2010 | Blair | |
| 2010/0329507 | A1* | 12/2010 | Manabe | G07D 7/0034 382/100 |
| 2011/0199649 | A1 | 8/2011 | Steidl | |
| 2012/0176605 | A1 | 7/2012 | Stoeckli et al. | |
| 2013/0044935 | A1 | 2/2013 | Minin et al. | |
| 2013/0088712 | A1 | 4/2013 | Holl et al. | |

FOREIGN PATENT DOCUMENTS

| | | | |
|---|---|---|---|
| DE | 102006027068 | A1 | 1/2007 |
| DE | 102008051758 | A1 | 4/2010 |
| DE | 102009032227 | A1 | 1/2011 |
| DE | 102010021803 | A1 | 12/2011 |

OTHER PUBLICATIONS

International Preliminary Report on Patentability from PCT Application No. PCT/EP2014/001055, dated Oct. 27, 2015.
International Search Report from PCT Application No. PCT/EP2014/001055, dated Jul. 28, 2014.

* cited by examiner

APPARATUS, METHOD AND ASSEMBLY FOR CHECKING VALUE DOCUMENTS, IN PARTICULAR BANK NOTES, AND VALUE-DOCUMENT PROCESSING SYSTEM

BACKGROUND

This invention concerns an apparatus and a method for checking value documents, in particular bank notes, and a value-document processing system.

In bank-note processing systems, properties of bank notes, such as printed image, denomination, authenticity and condition, are ascertained by capturing physical properties of the bank notes by means of sensors and evaluating the thereby generated sensor data.

Checking the condition, the so-called fitness, of a bank note involves checking whether it meets certain criteria to be able to be put back in circulation or have to be removed from circulation. Besides the degree of soiling and wear, an important criterion here is also the presence of unwanted foreign objects, usually in the form of adhesive tape or other stickers, on the bank note.

Checking the presence of adhesive tape is usually done by measuring the thickness of the bank note to be checked by means of mechanical or ultrasound thickness sensors.

From DE 10 2010 021 803 A1 it is further known to recognize by a dark-field transmission image of the bank note, if an adhesive tape was used to stick two bank note parts together. If the two bank note parts below the adhesive tape are slightly separated, their separation line appears bright in the transmission image, due to light scattering from the adhesive tape. From a bright separation line extending across the bank note one can infer that the bank note is suspicious to be a composed forgery. But if the two bank note parts being sticked together were not separated at all, no bright separation line would be detectable and thus the bank note would not be sorted out.

SUMMARY

It is the object of the present invention to state an apparatus, a method, a value-document processing system and an assembly that enable foreign objects, in particular adhesive tape or other stickers, located in the edge region of a value document to be recognized in a simple and reliable manner.

This object is achieved by the apparatus, the method, the value-document processing system and the assembly according to the independent claims.

The apparatus according to the invention for checking value documents, in particular bank notes, has: a sensor for capturing an electromagnetic radiation transmitted by a value document and generating corresponding transmission signals, and an evaluation device for checking whether the value document has a foreign object, in particular adhesive tape, taking into account transmission signals which correspond to the electromagnetic radiation respectively transmitted in the region of the edge of the value document.

The method according to the invention for checking value documents, in particular bank notes, has the following steps: capturing an electromagnetic radiation transmitted by a value document and generating corresponding transmission signals, and checking whether the value document has a foreign object, in particular adhesive tape, taking into account the transmission signals which correspond to the electromagnetic radiation respectively transmitted in the region of the edge of the value document.

The evaluation device is configured to ascertain an edge course of the value document from the transmission signals and to approximate a rectangle to the edge course of the value document. Further the evaluation device is configured to check whether the value document has a foreign object on a basis of any differences between the edge course of the value document ascertained from the transmission signals and the rectangle approximated to the edge course of the value document.

The value-document processing system according to the invention has at least one apparatus for processing, in particular conveying and/or counting and/or sorting, value documents, in particular bank notes, and is characterized by the apparatus according to the invention for checking value documents.

The invention is based on the idea of evaluating the transmission signals in the region of the edge of the value document when checking whether a foreign object, in particular adhesive tape or another sticker, is present on the value document. The presence of a foreign object is inferred on the basis of any differences between the edge course of the value document ascertained from the transmission signals and a rectangle approximated to the transmission edge course of the value document.

Compared to an evaluation wherein both transmission and remission signals are used by comparing an edge course ascertained from the transmission image to an edge course ascertained from the remission image, it is beneficial to use the transmission edge course alone, without using the edge course ascertained from the remission image, because comparing the transmission edge course with the remission edge course requires to synchronize the coordinates of the remission image with the transmission image before comparing their edge courses, i.e. to transform them into a common coordinate system. This synchronization can be difficult, as the remission image usually is detected by another optical sensor than the transmission image and both sensors usually have different optical imaging setups. As the remission properties are not needed for the inventive evaluation, the inventive evaluation whether a bank note has a foreign object located in the edge region of a value document, is simpler.

The approach according to the invention is particularly suitable for recognizing adhesive tape or other stickers located on value documents, which are stuck to the value document for example for repair purposes in order to remedy defects, in particular tears, usually occurring in the edge region of the value document. In particular, it makes it possible to recognize that adhesive tape that projects as far as the value document's cut edge or, where applicable, even slightly therebeyond.

As tests have shown, such adhesive objects are recognizable in the region of the edge of the recorded transmission image in the form of an elevated brightness relative to the background. This behavior can be explained by the fact that upon the capture of the transmission image, in particular a dark-field transmission image, the light impinging on the adhesive object is scattered beyond the value document's cut edge and is captured upon the transmission measurement. Alternatively or additionally to the scattering of the light, it is also possible that the impinging light is conducted from the adhesive object to the cut edge of the adhesive object and exits diffusely there, which as a result likewise has the consequence of light being emitted in the value document's corresponding edge region.

The approach according to the invention for recognizing foreign objects on the value document is particularly suited for objects that scatter, refract and/or conduct electromagnetic radiation in the visible and/or infrared and/or ultraviolet spectral region. There can be recognized both adhesive tape that appears clear and adhesive tape that appears matt and is nearly invisible on the bank note. However, this also holds in principle for adhesive tape that is substantially opaque in the visible spectral region, such as so-called insulating tape, which can scatter electromagnetic radiation in other spectral regions, in particular in the ultraviolet and/or infrared spectral region.

The transmission edge course of a bank note can show deviations from the rectangular shape of the bank note not only in the case of a foreign object, but also in the case of a distortion or deformation occurring at the edge of the value document. Such a distortion or deformation of the bank note can occur e.g. upon bank-note transport by machine and/or due to a cut edge that is not completely straight. But usually the deviations from the rectangular shape that is caused by a distortion or a deformation of the bank note, are lower than the deviations caused by a foreign object like an adhesive tape. Therefore, to distinguish the deviation caused by a foreign object from said other deviations, a (distance/area) comparison value (acting as a threshold) can be set between the typical deviation of a foreign object and the typical deviations of distortions or deformations, and the presence of a foreign object can be judged by comparing said comparison value with the deviation the transmission edge course has from the rectangle. The invention thus allows a simple and reliable recognition of foreign objects, in particular adhesive tape or other stickers, located in the edge region of a value document.

Preferably, the sensor is configured for spatially resolved capture of the electromagnetic radiation transmitted by the value document and for generating corresponding transmission signals. This enables the spatial course of the spatially resolved transmission signal, said spatial course being obtained in the region of the edge of the value document, in particular along its edge, to be taken into account upon the check of whether the value document has adhesive tape.

It is furthermore particularly preferred that the sensor is configured for generating a transmission image, in particular a dark-field transmission image, comprising the transmission signals. With a dark-field transmission image, the transmission image of the value document stands out from a dark image background, with well resolved, high-contrast transmission images nevertheless being obtained even at low contrasts in the value document. The value document is for this purpose subjected to electromagnetic radiation such that direct rays pass by the sensor and only those reach the sensor that are deflected, in particular refracted and/or scattered, in the value document.

According to a further preferred embodiment of the invention, the evaluation device is configured such that, upon the check of whether the value document has a foreign object, in particular adhesive tape, it compares with each other the edge course ascertained from the transmission signals in the region of the edge of the value document with a rectangle fitted to this edge course. If this comparison shows that the transmission edge course of the value document has substantially the spatial course of the rectangle fitted thereto, it can be inferred that no adhesive tape is located on the value document. However, if the spatial course of the transmission signals deviates from the rectangle fitted thereto at least in one region along the edge of the value document, the presence of adhesive tape can be inferred. As a result of this, value documents with adhesive tape in the edge region can be distinguished from those without adhesive tape reliably and in a simple manner.

In particular, the positions of (first) edge points which the transmission image yields are compared with the positions of the corresponding (second) edge points of the rectangle fitted to the transmission edge course. And for adhesive tape recognition, for one or more pairs of a first and a second edge point, the respective distance between an edge point of the transmission edge course and the corresponding edge point of the rectangle is determined and evaluated. Normally (without adhesive tape), the edge course observed in transmission is approximately congruent to a rectangle, i.e. the mutually corresponding edge points respectively have a very small distance apart which lies below a pre-specified distance comparison value. In the case of adhesive tape, however, said transmission edge course is not congruent to a rectangle, but rather one ascertains an elevated distance which exceeds a pre-specified distance comparison value, e.g. over a plurality of neighboring edge point pairs. Since the geometrical distortions or bulges of the bank note visible in the transmission image are very small, they usually lie below this distance comparison value. Geometrical distortions or bulges of adhesive tape can hence be distinguished from foreign objects. This prevents geometrical distortions or bulges of the bank note from being incorrectly taken for adhesive tape ("false tape") and the relevant bank note from being unnecessarily sorted out.

In a particularly preferred embodiment of the invention, the evaluation device is configured for ascertaining on the basis of the transmission signals one or more first edge points that correspond to points in the region of the edge of the value document. Further, the evaluation device is configured for fitting a rectangle to this first edge points and for using one or more points along the fitted rectangle as one or more second edge points, and for comparing at least the position of one of the first edge points with the position of at least one of the second edge points. The first and the second edge points whose positions are compared with each other lie at the same place on the value-document edge, viewed along the value-document edge running around the value document. On the basis of the spatial distance between the first and second edge points it is checked whether a foreign object, in particular adhesive tape, is present in the region of the edge of the value document. Preferably, the position of the first edge point and the position of the second edge point corresponding thereto are respectively compared for a plurality of pairs of a first and a second edge point which are mutually neighboring edge point pairs along the edge of the value document. Adhesive tape can thus be recognized especially reliably. In particular, the positions of first and second edge points obtained along each of the four edges of the value document are compared with each other.

Preferably, the evaluation device is configured for ascertaining the first edge points by a comparison of the transmission signals with at least one threshold value. Thus, the level of the transmission signals is compared with a first threshold value for example in the transmission image, with transmission signals greater than the first threshold value being associated with the transmission image of the value document, whereas transmission signals smaller than the first threshold value are associated with the background surrounding the value document in the transmission image. On this basis an edge recognition can then be effected by means of an edge detection algorithm, by which an transmission edge course comprising a plurality of first edge points is ascertained. The first edge points are ascertained especially exactly by means of threshold value comparison and edge detection, which further increases the reliability of the adhesive tape recognition.

It is further preferred that the evaluation device is configured for ascertaining at least one distance value which represents a measure of the spatial distance of one of the first edge points from one of the second edge points of the fitted rectangle, and in particular comparing the at least one distance value with at least one pre-specified distance comparison value.

Furthermore, it is preferred that the at least one distance comparison value corresponds to a distance value ascertained in advance on the basis of at least one value document on which no foreign object, in particular no adhesive tape, is located. The distance comparison value can be identical for all four edges of the value document, but can also be determined separately for individual edges or each of the edges.

For example, the at least one distance value corresponds to the Euclidean distance between a first and a second edge point in each case. Alternatively, however, it is also possible to determine as a distance value for example only the difference of that coordinate, e.g. the x coordinate, of the first and second edge points that extends perpendicularly to the respective edge, i.e. along the y direction, of the value document.

Alternatively or additionally to determining the distance, one can also determine the size of an area, defined by the edge points, which the edge course obtained from the transmission image encloses with the fitted rectangle, e.g. by integration or by adding up the respective distance values, and check whether it exceeds a pre-specified area comparison value F. If the area comparison value is exceeded, the presence of a foreign object is affirmed, otherwise negated.

Additionally or alternatively, statements about the presence of adhesive tape on the value document can be derived on the basis of a statistical evaluation of the brightness, i.e. the level of the transmission signals, at the first edge points. Mean values and/or variance values of the brightness can e.g. be determined for this purpose.

The respective first and second edge points from which a distance value is respectively ascertained are mutually corresponding points along the value-document edge. For example, considering the two bank note edges oriented parallel to an x-axis of a transmission image, the corresponding first and second edge points have the same x-coordinate but possibly (if a foreign object leads to a deviation from the rectangle) different y-coordinates. For the two other bank note edges oriented parallel to an y-axis of the transmission image, the corresponding first and second edge points have the same y-coordinate but possibly (if a foreign object leads to a deviation from the rectangle) different x-coordinates.

For example, the distance value is respectively ascertained for a plurality of pairs of a first and a second edge point which are preferably mutually corresponding edge point pairs along the edge of the value document, and it is checked whether a pre-specified minimum number N of (corresponding) pairs of edge points exceeds the distance comparison value A. If the distance comparison value A is exceeded for at least a pre-specified minimum number N of (preferably neighboring) pairs of edge points, the presence of foreign object, in particular adhesive tape, is affirmed and otherwise negated.

For example, the evaluation device is configured for ascertaining a number n of distance values greater than the distance comparison value, and in particular performing the check of whether the value document has a foreign object, in particular adhesive tape, on the basis of a comparison of the ascertained number n of distance values greater than the distance comparison value, with a pre-specified number N of distance values.

For example, the minimum number amounts to N>2, preferably N>4. By the pre-specified number N it can be specified in a simple manner in how many, preferably neighboring, edge points of the transmission edge course must differ from the fitted rectangle in order to reliably infer the presence of adhesive tape.

The ascertained number n can also be compared to more than one pre-specified numbers N (different numbers N1, N2, . . . ), e.g. in order to quantify the suspicion that the value document has a foreign object or in order to distinguish between foreign objects having different widths along the edge of the value document.

Additionally, an upper limit can be pre-specified for the number of edge point pairs exceeding the distance comparison value, said limit being chosen in dependence on the maximum width of the adhesive objects to be recognized, and the presence of adhesive tape only affirmed when the upper limit is also undershot. The distinction between value documents with and without adhesive tape thereby becomes even more reliable.

The inventive approach can also be combined with one or more other approaches that are useful to check if a value document has a foreign object. If any of the inventive or of the other approaches leads to an suspicion that the value document probably has a foreign object, the respective value document is sorted out and thereby separated from the other value documents that passed the foreign object checks.

BRIEF DESCRIPTION OF THE DRAWINGS

Further advantages, features and possibilities of application of the present invention will result from the following description in connection with the figures. There are shown.

DETAILED DESCRIPTION OF VARIOUS EMBODIMENTS

Figure 1:
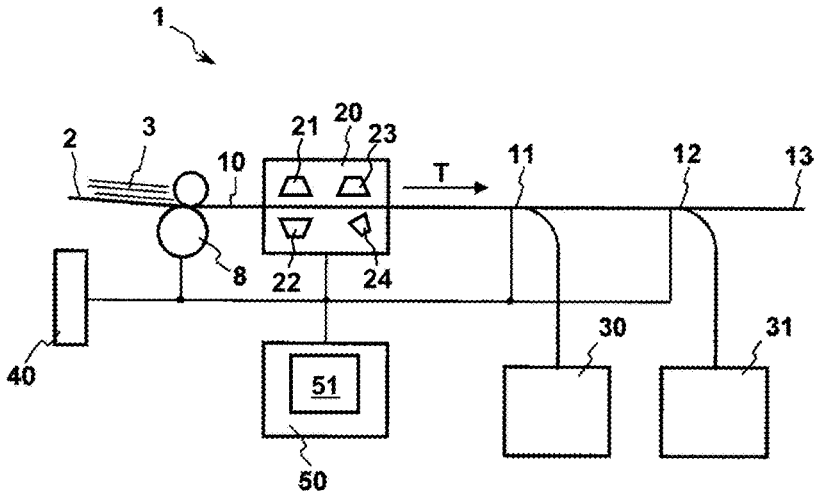
FIG. 1 an example of a schematic construction of a value-document processing system.

FIG. 1 shows an example of a schematic construction of a value-document processing system 1 having an input pocket 2 in which a stack of value documents, in particular bank notes 3, to be processed is supplied, and a singler 8 from which the respectively lowermost bank note of the inputted stack is grasped and delivered to a transport device 10—rendered only schematically in the chosen representation—which conveys the bank note to a sensor device 20 in transport direction T.

The sensor device 20 comprises in the represented example a first, second and third sensor 21, 22, 23 which are respectively preferably configured as a so-called line-scan cameras and capture light emanating from the bank note by means of sensor elements arranged along a line, in particular in the visible and/or infrared and/or ultraviolet spectral region, and convert it into corresponding sensor signals.

In the represented example, the first and second sensors 21, 22 capture light remitted, i.e. diffusely and/or directionally reflected, by the front side or back side of the bank note and convert it into corresponding remission signals. The third sensor 23 located in the region of the front side of the bank note, however, captures the light transmitted through the bank note, said light being emitted by a light source 24, obliquely impinging on the bank note and passing through it, and converts it into corresponding second sensor signals. Due to the light from the light source 24 impinging on the bank note obliquely, the third sensor captures a so-called dark-field transmission image, in which the bank note appears light and its surroundings or background dark. The first and second sensors 21, 22 are also designated remission cameras, and the third sensor 23 is also designated a transmission camera. The two remission cameras 21, 22 are not necessary for the present invention, however, they are usually used in addition to the transmission sensor 23, for example to check the denomination and authenticity of bank notes.

Preferably, the line with the sensor elements of the transmission sensor 23 extends substantially perpendicularly to the transport direction T of the bank notes, so that there is obtained upon each readout operation of the sensor line of the transmission sensor 23 a transmission signal course, along the sensor line, which corresponds to an intensity course of the light that is transmitted through the bank note in a direction extending perpendicularly to the transport direction T.

The transmission signals generated by transmission sensor 23 of the sensor device 20, in particular the corresponding transmission signal course, is relayed to a control device 50 as well as an evaluation device 51. The evaluation device 51 can be contained in the control device 50 or else form a unit separate from the control device 50.

In the evaluation device 51 the transmission signals of transmission sensor 23 as well as the remission signals of the first and second sensors 21, 22, possibly after preprocessing, are drawn on for checking the bank note, with statements being derived from the respective sensor signals about different properties of the respective bank note, such as authenticity or condition of the bank note, in particular degree of soiling, wear, defects and the presence of foreign objects, such as adhesive tape and other stickers, but also paper clips and staples. Soiling, wear and defects can be recognized from the remission image and/or transmission image using known evaluation methods, and the presence of foreign objects using the evaluation according to the invention.

Depending on the properties of the respective bank note that are ascertained in the evaluation device 51, the transport device 10 as well as the gates 11 and 12 along the transport line are controlled by the control device 50 such that the bank note is fed to one of a plurality of output pockets 30 and 31 and deposited there. For example, bank notes in good condition, in particular having no foreign objects such as adhesive tape, are deposited in a first output pocket 30, while bank notes in poor condition, e.g. bank notes with adhesive tape, are deposited in a second output pocket 31. Reject bank notes are deposited in a further pocket (not shown).

The reference number 13 at the end of the represented transport line in intended to indicate that further output pockets and/or other devices can be provided, for example for storing or destroying bank notes. If for example the check of a bank note shows that it does not meet certain condition criteria with regard to soiling, wear, defects or the presence of foreign objects, it can be fed directly to a shredder for destruction.

The value-document processing system 1 further comprises, in the represented example, an input/output device 40 for inputting of data and/or control commands by an operating person, for example by means of a keyboard or a touchscreen, and outputting or display of data and/or information about the processing operation, in particular about the respectively processed bank notes.

The value-document processing system 1 shown by way of example is especially suitable for checking value documents for the presence of foreign objects, such as adhesive tape and other stickers, which will be explained more closely hereinafter.

Figure 2:
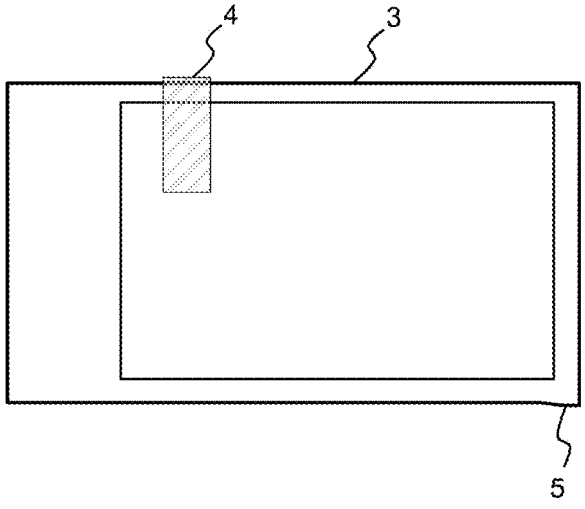
FIG. 2 an example of a value document in the form of a bank note.

FIG. 2 shows an example of a value document in the form of a bank note 3—represented only very schematically in the present case—bearing adhesive tape 4 which projects slightly beyond the edge of the bank note 3 in the represented example. For illustrative reasons, the adhesive tape 4 protrudes beyond the edge of the bank note 3 in a clearly visible manner. However, the following comments also apply accordingly to adhesive tape or other comparable foreign objects on the bank note 3 that are flush with the edge of the bank note 3.

The adhesive tape 4 can in principle be any kind of adhesive tape, such as adhesive tape that is transparent and/or clear and/or matt and/or light-transmissive only in the checked spectral region.

The bank note 3 shown in FIG. 2 has a deformation 5 in the region of its lower right corner, which has been represented in enlarged form in the present example again for illustrative reasons, and can have different causes, such as a cut edge of the bank note 3 that is imperfect for manufacturing reasons or a distortion caused by the transport of the bank note 3 in a bank-note processing system. In the represented example, the deformation 5 is represented as a projection relative to the rest of the course of the lower cut edge of the bank note 3. However, the following comments also apply accordingly to other kinds of deviations of the outer shape of the bank note 3 from the conventional rectangular bank-note shape.

Figure 3:
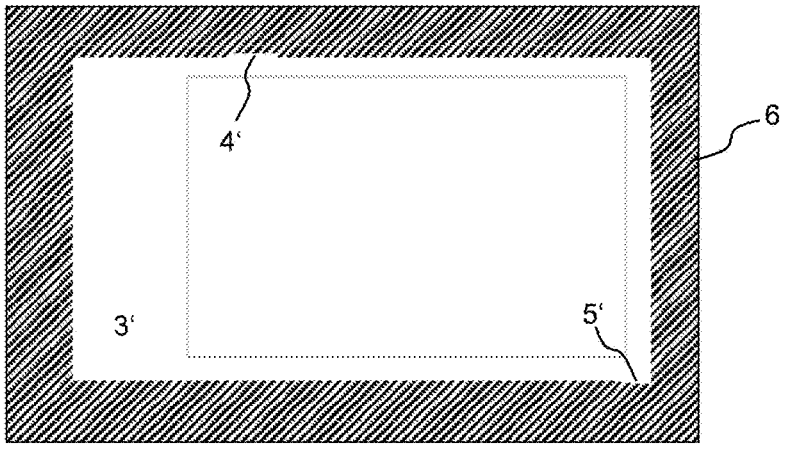
FIG. 3 an example of a transmission image of the bank note shown in FIG. 2.

FIG. 3 shows an example of a transmission image 3' of the bank note 3 shown in FIG. 2. The transmission image 3' represented here is preferably a so-called dark-field transmission image, which is obtained by light being emitted from the light source 24 (see FIG. 1), and impinging on the bank note 3, obliquely, i.e. at an angle clearly different from 90°, with regard to the area of the transmission camera 23. The light passing through the bank note 3 is captured by the transmission camera 23 and converted into corresponding transmission signals which compositely yield the transmission image 3'. The light passing by the bank note 3 and passing by the transmission camera 23 leads to the transmission image 3' of the bank note 3 appearing against a substantially completely dark background 6 in the transmission recording shown here.

The transmission image 3' of the bank note 3 shows a region 4' having an elevated brightness relative to the dark background 6, which is due to the fact that the light impinging on the bank note 3 is scattered and/or refracted by the adhesive tape 4 towards the transmission camera 23 and—unlike the illumination light passing by the transmission camera 23—is captured by the transmission camera 23. In the transmission image 3' of the bank note 3 there is further to be recognized a region 5' corresponding to the deformation 5.

After the recording of the transmission image 3' of the bank note 3, the course of the edge of the transmission image 3' is ascertained from the transmission image 3', e.g. by comparing the transmission signals in the region of the image 3' and the background 6 with a threshold value. In so doing, transmission signals whose level exceeds the pre-specified threshold value are associated with the transmission image 3', while transmission signals undershooting the pre-specified threshold value are associated with the background 6.

Subsequently, an edge detection is carried out on the transmission recording, by which a course VT, comprising a plurality of edge points T(x, y) of the edge of the transmission image 3' of the bank note 3 is respectively ascertained, said course being represented by way of example in FIG. 4. The represented edge course VT of the transmission image 3' shows a region 5' corresponding to the deformation 5 at the edge of the bank note 3 as well as a region 4' corresponding to the position of the adhesive tape 4.

Subsequently, a rectangle VR is fitted to the edge course VT of the transmission image 3'. This can be done by fitting four straight lines to the four sides of the edge course VT. Thereby, the four straight lines are iteratively approximated to the edge course VT until the deviation of the rectangle (formed by the four straight lines) from the edge course VT is minimal. The fitting is done under the constraint that the four straight lines form a rectangle, i.e. there is an angle of 90° between all neighboring lines. Thereby or alternatively, a linear regression analysis can be used for the fitting. The fitting results in the rectangle VR shown in FIG. 5, comprising a plurality of edge points R(x, y) forming the rectangle.

Figure 4:
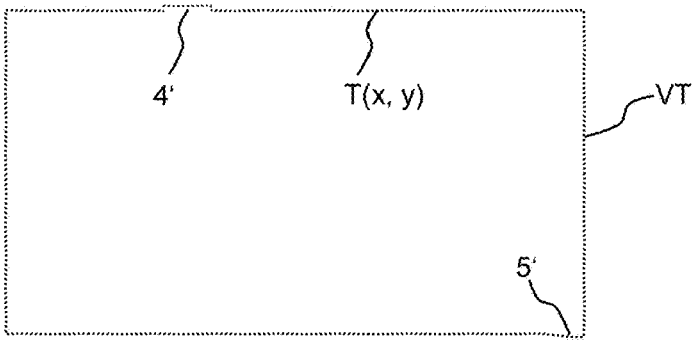
FIG. 4 an example of the transmission edge course ascertained from the transmission image.
Figure 5:
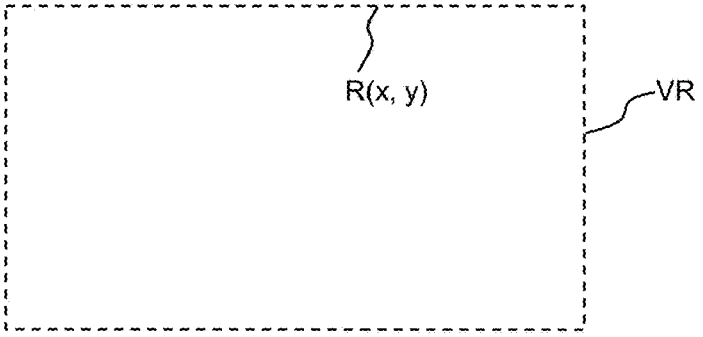
FIG. 5 a rectangle fitted to the transmission edge course.
Figure 6:
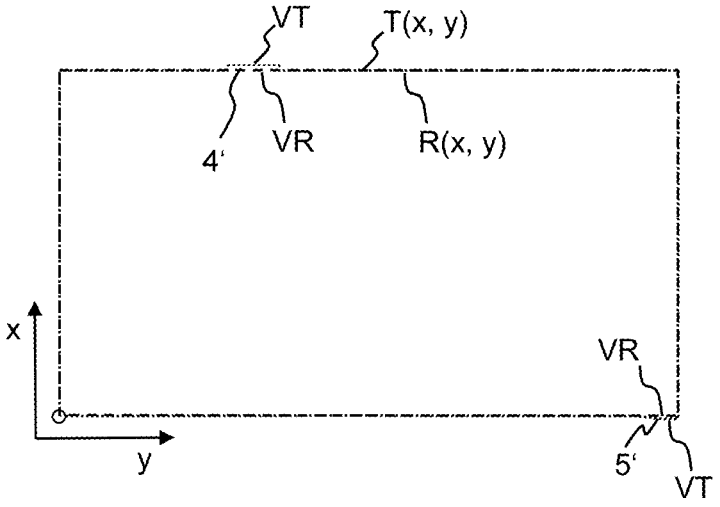
FIG. 6 a superimposition of the transmission edge course of FIG. 4 and the rectangle of FIG. 5.

FIG. 6 shows a superimposition of the edge course VT of FIG. 4 and the fitted rectangle VR of FIG. 5. The edge course VT of transmission image 3' deviates from the rectangle VR in the region 5' corresponding to the deformation 5 at the edge of the bank note 3 and in the region 4' corresponding to the position of the adhesive tape 4.

Starting out from the edge course VT and the rectangle VR brought almost entirely into coincidence, a distance value D is then respectively computed for one or more pairs of edge points T(x, y) of the transmission image and edge points R(x, y) of the rectangle VR, said value representing a measure of the distance between the first edge points T(x, y) from the corresponding second edge points R(x, y). For example, there is computed as a distance value D the so-called Euclidean distance between the respective two points T(x, y) and R(x, y) as follows:

$$D=\sqrt{(x_T-x_R)^2+(y_T-y_R)^2}$$

where $x_T$ and $y_T$ represent the coordinates of the first edge point T(x, y), and $x_R$ and $y_R$ the coordinates of the second edge point R(x, y).

In principle it is possible to compute one or more distance values D only in certain portions along the edge course VT and the rectangle VR. However, it is preferred to determine the distance values D for many or all pairs of first and second edge points T(x, y), R(x, y) along the edge courses VT and the rectangle VR in order to be able to recognize any adhesive tape on the bank note with especially high reliability.

Figure 7:
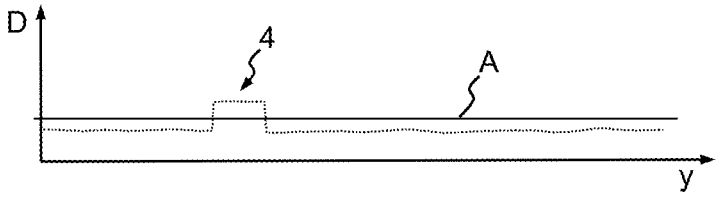
FIG. 7 a first example of the course of distance values ascertained from first and corresponding second edge points along the edge course.

FIG. 7 shows a first example of the course of distance values D ascertained from first and second edge points T(x, y) and R(x, y), along the y direction of the upper edge of the obtained transmission image 3' of the bank note 3. Additionally, FIG. 7 shows the distance comparison value A which was ascertained in advance on the basis of bank notes having no adhesive tape or similar foreign objects. The distance comparison value A can be chosen in dependence on the measuring accuracy of the image recording. For example, a length of 1, 2 or 3 pixel sizes of the transmission image can be employed as a distance comparison value A. The distance values D exceeding the distance comparison value A in one region along the y direction, one can infer a significant deviation of the edge course VT of the transmission image in comparison to the rectangle VR, and thus one can infer, that an adhesive tape 4 is located on the bank note 3 in this region.

Figure 8:
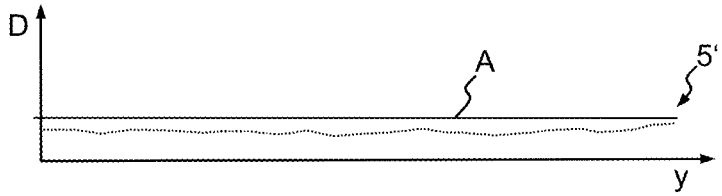
FIG. 8 a second example of the course of distance values ascertained from first and corresponding second edge points along the edge course.

In comparison, FIG. 8 shows a second example of the course of distance values D ascertained from first and second edge points T(x, y) and R(x, y), along the y direction on the lower edge of the obtained transmission image 3' of the bank note 3. In the region of the deformation 5 of the bank note 3 the distance values D are slightly increased, but unlike in the region of the adhesive tape 4, the distance values D ascertained in the region of the deformation 5 do not exceed the distance comparison value A. Thus, one can infer that no adhesive tape is located at this place on the bank note 3.

Using the hereinabove described method, or using the corresponding apparatus, one can thus distinguish in a simple and reliable manner whether an adhesive tape is located in an edge region of the bank note.

The invention claimed is:

1. An apparatus for checking value documents comprising:

a sensor for capturing an electromagnetic radiation transmitted by a value document and for generating a transmission image of the value document comprising transmission signals corresponding to the electromagnetic radiation transmitted by the value document, and an evaluation device for checking whether the value document has a foreign object taking into account the transmission signals;

the evaluation device is configured for ascertaining an edge course of the value document on the basis of the transmission signals;

approximating a rectangle to the edge course of the value document;

checking whether the value document has a foreign object on a basis of any differences between the edge course of the value document ascertained from the transmission signals and the rectangle approximated to the edge course of the value document.

2. The apparatus according to claim 1, wherein the edge course comprising a plurality of first edge points which correspond to the edge of the value document and the rectangle comprising a plurality of second edge points forming the rectangle.

3. The apparatus according to claim 2, wherein the evaluation device is configured for comparing the position of at least one of the first edge points with the position of at least one of the second edge points in order to ascertain a spatial distance between the respective first and the second edge point and/or an area between the first and the second edge points, with the positions of those first and second edge points being compared with each other that are mutually corresponding points along the edge of the value document; and checking on the basis of the spatial distance and/or the area whether a foreign object, is present in the region of the edge of the value document.

4. The apparatus according to claim 3, wherein the evaluation device is configured for comparing the spatial distance with at least one pre-specified distance comparison value, and/or the area with at least one pre-specified area comparison value, and, if the distance exceeds the distance comparison value and/or the area exceeds the area comparison value, for affirming the presence of a foreign object and otherwise negating the presence of a foreign object.

5. The apparatus according to claim 4, wherein the at least one distance comparison value/area comparison value corresponds to a distance value/area value ascertained on the basis of at least one value document on which no foreign object is located.

6. The apparatus according to claim 1, wherein the evaluation device is configured for comparing the transmission signals of the transmission image with at least one threshold value in order to distinguish the transmission signals in an image area of the value document from the transmission signals in a background area surrounding the image area of the value document.

7. The apparatus according to claim 6, wherein, the evaluation device is configured for selecting a plurality of first edge points from those image points of the transmission image lying on the border between the image area of the value document and the background area of the value document and for ascertaining the positions of a plurality of the first edge points therefrom.

8. The apparatus according to claim 1, wherein the evaluation device is configured for ascertaining the edge course of the value-document from the transmission signals by means of edge detection and for ascertaining the positions of a plurality of the first edge points therefrom.

9. The apparatus according to claim 1, wherein the evaluation device is configured for approximating the rectangle to the edge course of the value document by fitting four straight lines to the edge course of the value document, under the constraint that the four straight lines form a rectangle.

10. The apparatus according to claim 9, wherein the evaluation device is configured for fitting the four straight lines forming a rectangle to the edge course of the value document by means of linear regression analysis.

11. The apparatus according to claim 9, wherein the evaluation device is configured for iteratively approximating the four straight lines to the edge course of the value document until the deviation of the rectangle formed by the four straight lines from the edge course is minimal.

12. The apparatus according to claim 2, wherein the evaluation device is configured for ascertaining a distance value for the spatial distance between the respective first edge point and the respective second edge point which corresponds to the respective first edge point along the edge of the value document, said distance value representing a measure of the spatial distance of the respective first edge point from the respective second edge point.

13. The apparatus according to claim 2, wherein the evaluation device is configured for:

respectively ascertaining a distance value for a plurality of pairs of a first and a second edge point corresponding to the respective first edge point along the edge of the value document; and checking whether a pre-specified minimum number of pairs of edge points exceeds the distance comparison value; and if the distance value exceeds the distance comparison value for at least a pre-specified minimum number of pairs of edge points, affirming the presence of a foreign object and otherwise negating the presence of a foreign object.

14. The apparatus according to claim 2, wherein the evaluation device is configured for respectively ascertaining a distance value for a plurality of pairs of a first and a second edge point corresponding to the respective first edge point along the edge of the value document; and ascertaining a number of distance values that are greater than the distance comparison value; and carrying out the check of whether the value document has a foreign object on the basis of a comparison of the ascertained number of distance values that are greater than the distance comparison value with a pre-specified minimum number of distance values.

15. The apparatus according to claim 12, wherein the at least one distance value is the Euclidean distance between a first and a second edge point in each case.

16. The apparatus according to claim 1, wherein the at least one sensor is configured for spatially resolved capture of the electromagnetic radiation transmitted by the value document.

17. A value-document processing system having at least one apparatus for processing value documents, and having an apparatus for checking value documents according to claim 1.

18. A method for checking value documents, having the following steps:

using a sensor for capturing an electromagnetic radiation transmitted by a value document and for generating corresponding transmission signals;

using an evaluation device for checking whether the value document has a foreign object taking into account the transmission signals generated by the sensor;

wherein the evaluation device is configured for ascertaining an edge course of the value document on the basis of the transmission signals;

approximating a rectangle to the edge course of the value document;

checking whether the value document has a foreign object on a basis of any differences between the edge course of the value document ascertained from the transmission signals and the rectangle approximated to the edge course of the value document.

19. The method according to claim 18, wherein the edge course comprising a plurality of first edge points which correspond to the edge of the value document and the rectangle comprising a plurality of second edge points forming the rectangle.

20. The method according to claim 19, wherein the evaluation device compares the position of at least one of the first edge points with the position of at least one of the second edge points in order to ascertain a spatial distance between the respective first and the second edge point and/or an area between the first and the second edge points, with the positions of those first and second edge points being compared with each other that are mutually corresponding points along the edge of the value document; and checks on the basis of the spatial distance and/or the area whether a foreign object, is present in the region of the edge of the value document.

21. An assembly for checking value documents comprising:

a sensor for capturing an electromagnetic radiation transmitted by a value document and for generating a transmission image of the value document comprising transmission signals corresponding to the electromagnetic radiation transmitted by the value document, and an evaluation device for checking whether the value document has a foreign object taking into account the transmission signals;

the evaluation device is configured for ascertaining an edge course of the value document on the basis of the transmission signals;

approximating a rectangle to the edge course of the value document;

checking whether the value document has a foreign object on a basis of any differences between the edge course of the value document ascertained from the transmission signals and the rectangle approximated to the edge course of the value document.

* * * * *